United States Patent [19]

Horton et al.

[11] Patent Number: 4,838,162

[45] Date of Patent: Jun. 13, 1989

[54] SYSTEM FOR PRINTING BOTH SIDES OF ENVELOPES

[75] Inventors: Gilbert L. Horton, Kernersville; Eddie D. Poole, Lexington; William A. Borst, Burlington, all of N.C.

[73] Assignee: Sara Lee Corporation, Winston-Salem, N.C.

[21] Appl. No.: 113,988

[22] Filed: Oct. 29, 1987

[51] Int. Cl.[4] ..... B41F 1/12; B41F 1/20

[52] U.S. Cl. ..... 101/296; 101/27; 101/242; 271/245

[58] Field of Search ..... 101/296, 11, 27, 44, 101/43, DIG. 3, 289, 290, 193, 242, 241, 239, 233; 271/227, 245, 246

[56] References Cited

U.S. PATENT DOCUMENTS

| | | | |
|---|---|---|---|
| 1,369,934 | 3/1921 | Onstad | 101/11 X |
| 2,205,216 | 6/1940 | Loughery | 101/193 |
| 2,250,677 | 7/1941 | Paulsen | 101/290 X |
| 2,547,602 | 4/1951 | Schmitt | 101/44 |
| 2,758,538 | 8/1956 | Crink et al. | 101/57 |
| 2,851,944 | 9/1958 | Prohaska | 101/44 |
| 2,925,773 | 2/1960 | Kingsley | 101/11 |
| 3,180,253 | 4/1965 | Hildmann | 101/41 |
| 3,435,760 | 4/1969 | Harrison | 101/27 X |
| 3,732,807 | 5/1973 | Robertson | 101/11 |
| 3,812,779 | 5/1974 | Cobb | 101/44 X |
| 3,911,813 | 10/1975 | Schaeffer | 101/43 |
| 4,470,349 | 9/1984 | Godlewski | 101/233 |
| 4,527,475 | 7/1985 | Davison | 101/27 X |

*Primary Examiner*—Clifford D. Crowder

*Attorney, Agent, or Firm*—Charles Y. Lackey; William S. Burden

[57] ABSTRACT

A system of printing information on opposite sides of paper board envelopes using heat sensitive films or foils fed between transfer die members and envelopes passing therebetween. The system includes a supply magazine or the like, a conveying system for conveying the envelopes from the supply source to and through the several printers. The printers are longitudinally spaced along the conveyor path and are so located such that information can be printed on both sides of the envelope. At the end or the last printing station a second conveyor or transfer device is provided to transfer the just printed envelopes to a work station wherein delicate articles, such as hosiery, panty hose, etc., are placed therein. The system includes common and well known automatic control means to intermittently feed the envelopes to the several printing stations and subsequently to the envelope filling station.

11 Claims, 2 Drawing Sheets

FIG. 1
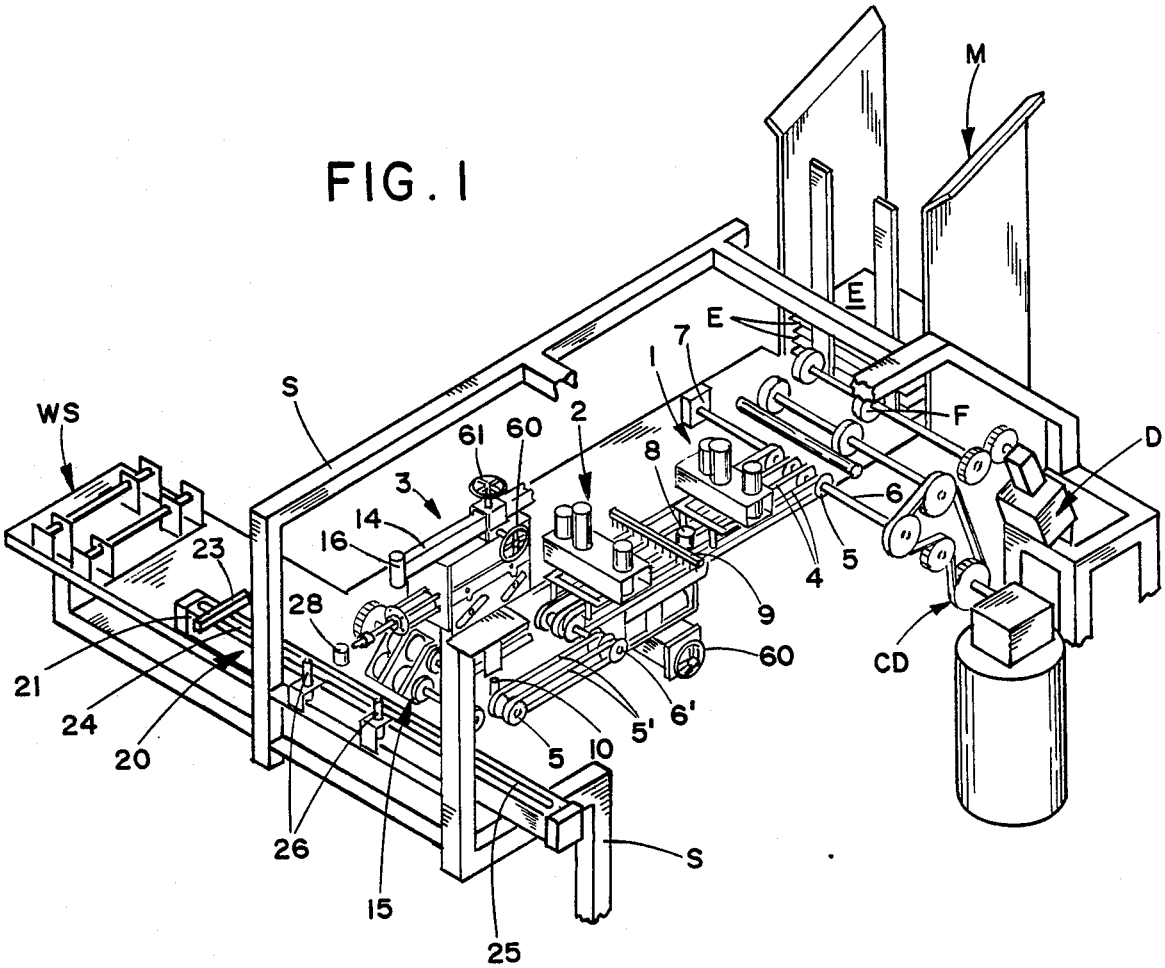
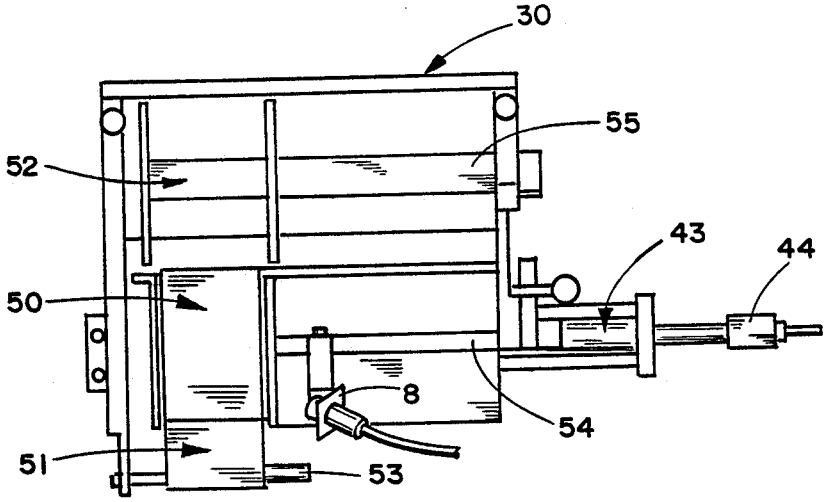
FIG. 2

SYSTEM FOR PRINTING BOTH SIDES OF ENVELOPES

BACKGROUND OF THE INVENTION

Printing systems for printing articles with identification indicia such as trade names, universal product codes, optical character reading codes, inventory control, product prices, sizes, colors, etc. are well known and may include multi-station arrangements in which the articles to be printed are passed successively to plural printing stations where each article is printed with different information at each station. In situations where different information is desired on opposite sides of the articles they must be turned over and fed through the machine or system again. This, of course, requires changing the indicia on the printing heads. Once these articles are printed they are usually stored until used, at which time they are matched with the product to be associated therewith.

THE PRIOR ART

The following listed patents show plural station printing machines but do not disclose a printing system of the type disclosed and claimed herein which can be a component of a continuous assembly or manufacturing line wherein an article receiving envelope can be formed, e.g. cut out, folded, etc., conveyed to a printing station, then to filling boxing, and cartoning stations, and finally to a storage station while only requiring the printing plates to be changed to conform to the product associated therewith:

1. U.S. Pat. No. 2,205,216, Loughery, 6/18/40
2. U.S. Pat. No. 2,758,538, Crinketal, 8/14/56
3. U.S. Pat. No. 3,180,253, Hildmann 4/27/65
4. U.S. Pat. No. 3,911,813, Scheaffer 10/14/75

The Robertson U.S. Pat. No. 3,732,807, 5/15/73 shows opposite side printing but does not hint at the specific improvement disclosed and claimed herein.

SUMMARY OF THE INVENTION

The present invention relates to a system of printing information indicia on opposite sides of a generally flat product carrying cardboard envelope or the like which is readily adaptable for insertion into an assembly line type operation and which avoids the shortcomings of the prior art mentioned above. As will be discussed specifically later on, the system includes a novel arrangement of printing stations located in the path of a conveyor located in an assembly line between other work stations, including an envelope filling station. Each printing station includes substantially identical printing devices through which the envelopes are conveyed and temporarily stopped to permit information indicia to be printed thereon. The example presented illustrates three identical printers, two of which print on the "top" of the envelope while the other prints on the "bottom" thereof. The "bottom" printer is merely turned upside-down relative to the other two printers. Each printer includes a vertically spaced removable heated printing plate and an anvil or reaction platen. The heated printing plate is mounted to reciprocate towards and away from the anvil or platen. The anvil is adjustable mounted toward and away from the printing plate to compensate for different thicknesses of envelopes.

Further features, advantages and objects of the invention will be best understood from the following detailed description of the specific embodiment when read in connection with the accompanying drawings, in which:

FIG. 1 is a schematic perspective elevational view of the printing system with parts removed for clarity;

FIG. 2 is a schematic top view of a printer;

DETAILED DESCRIPTION OF THE INVENTION

Figure 3:
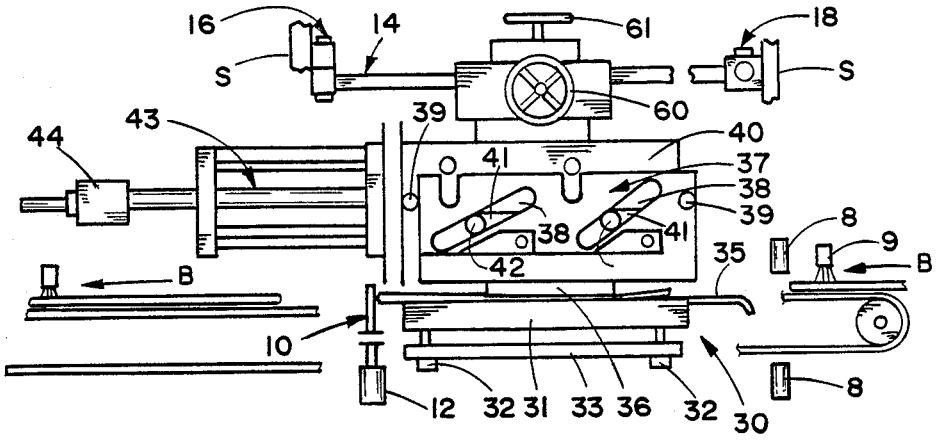
FIG. 3 is a schematic side view of a printer.

Referring first to FIG. 1 of the drawings, the system includes a supply magazine M for holding a stack of envelopes E to be conveyed to printing devices 1, 2 and 3. It should be noted here that parts of the printers 1, 2 and 3 have been removed for purposes of clarity. While printers 1 and 2 are disclosed as top printers and printer 3 is a bottom printer this is merely descriptive as any arrangement and any number of printers could be employed and still fall within the intended scope of the invention. Preferably each printer is pivotably supported upon the main frame S to provide easy access to the various printer components. As shown by FIG. 3, each printer includes a support arm or frame 14 supported at one end by a pivot pin means 16 fixed to the frame S and the opposite end of frame 14 is releasably coupled to frame S by a fastener means 18.

Figure 4:
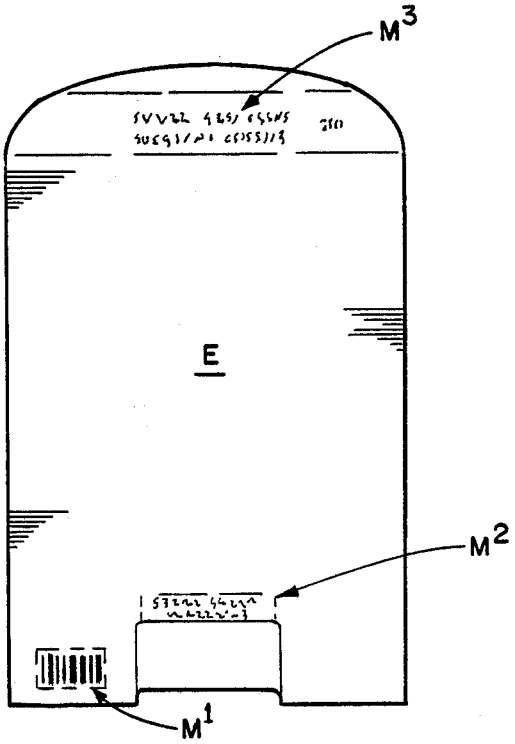
FIG. 4 and 5 show opposite sides of printed envelopes.
Figure 5:
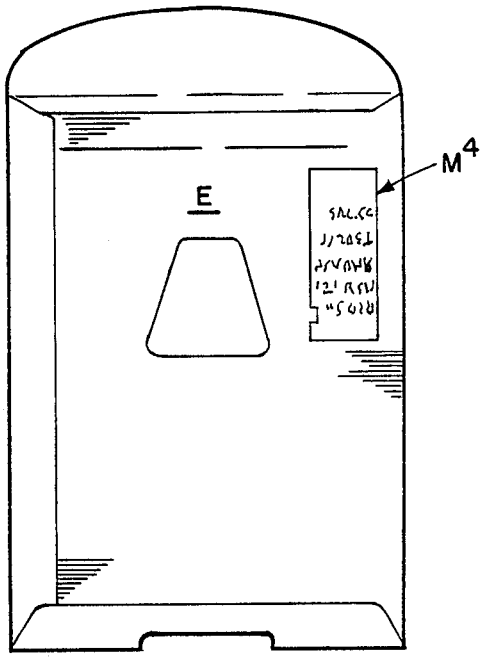
Figure 6:
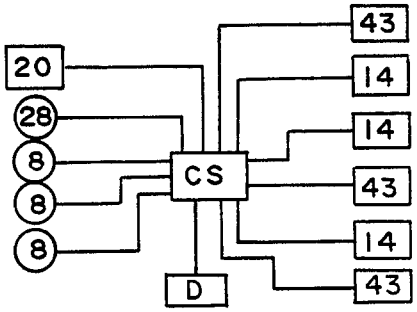
FIG. 6 is simplified block diagram of various components.

Envelopes E are fed from magazine M by feeder arrangement F driven by feeder drive D which could include any conventional motor. At or near the exit side or mouth of the magazine is located a group of endless conveyor belts 4 mounted on and driven by pulleys 5 fixed to shaft 6 mounted at one end in a support and bearing arrangement 7 in the main frame or support S, and at the other end to conveyor drive CD and to frame structure not shown. On the entrance or inboard side of each printer, e.g., the side receiving the incoming envelopes to be printed, are mounted control sensing detectors 8, FIGS. 1 and 3, for detecting incoming envelopes and brush-like means 9 to press the envelopes E against belts 4 to ensure firm contact therebetween. The detectors or sensors may take any well known form and the ones illustrated are vertically spaced electric eyes, the purpose of which will be subsequently disclosed. At the exit or outboard side of each printer are stop pins 10 connected to and selectively actuated by a fluid cylinder 12, FIG. 3. The cylinder 12 moves the pins between a retracted position permitting passage of an envelope and an extended position in the path of an envelope. As pointed out above, printers 1 and 2 are located on one side of the envelope, except the reaction plate and anvil while the third printer is located on the opposite side of the envelope. The third printing arrangement requires a slightly different positioning of the conveyor belts, e.g. the belts 5' are spaced apart further. This is necessary because the moveable heated printing plate must move toward the fixed anvil and thus between the laterally spaced runs of the belts. The belts 5' are supported upon pulleys 5 secured to shaft 6' which, in turn, is driven from belts 4. Note the difference in sizes of the printed matter in FIGS. 4 and 5. In FIG. 4 the area of printed matter is narrow enough to permit the printing plates to pass between the relative close spacing of the belts 5' while the size of the printing plate required for that illustrated in FIG. 5, is much larger. At the exit end of printer 3 is located an extraction device 15 driven by conveyor belts 5, to move the printed envelope to a pushing or transfer device generally indicated by numeral 20 which pushes or transfers the printed envelopes to a work station WS at which station merchandise is placed therein. Pushing or transfer device 20 is comprised of a cylinder 21 having therein a rodless piston attached to an elongated envelope engaging plate 23 by an element 24 adapted to reciprocate back and forth along cylinder 21 through slot 25. Stop means 26 are located on frame S at the exit end of printer 3 to stop and locate the printed envelope on pusher 20. Sensing means 28 is also located at the exit of printer 3 to sense the presence of an envelope E and command pusher or transfer device 20 to move same to the work station WS.

In view of the fact that the printers are generally alike only one is specifically illustrated and described. Attention is directed to FIGS. 2 and 3 which show the details of a printer as employed in this system. The printer generally noted by reference character 30 includes a lower reaction platen member or anvil 31 which is vertically adjustable by screws 32 associated therewith and a support plate 33 connected in any convenient manner to the main support frame S. Adjusting screws 32 provide for a paralleling of anvil 31 and a rough height adjustment or position. An adjusting nut 44 offers final fine adjustment for different thicknesses of the materials or envelopes to be printed. At the entrance end of the anvil 31 is a guide plate having a downwardly tapered end 35 to insure that the envelopes are properly positioned as they approach the printer. Directly above the anvil 31 is a vertically reciprocatable heated printing plate 36 attached to a slideable, generally U-shaped housing 37 having tapered or inclined slots 38 on each leg of the U-shaped housing. This housing 37 can take any number of forms or shapes and the same is not critical to the understanding of the invention. Printing plate 36 is located at the bottom or bite portion of said housing. A second housing 40 is partially embraced by the first named housing 37 and includes horizontally located slots 41 through which follower pins 42 extend as well as through the tapered or inclined slots 38. Bearings 39 are secured to and located at opposite end portions of housing 40 and abutting end portions of the housing 37, as shown by FIG. 3. The bearings 39 confine or restrict movement of housing 37 to displacement in a vertical plane, upon actuation of a fluid cylinder arrangement 43. The follower pins 42 are attached to the rod portion of the piston cylinder arrangement 43 and actuated in a well-known manner.

FIG. 2 is a top view of a printer which shows the printing film arrangement which includes a supply reel 50 having film 51 thereon and a take up reel 52 for the spent film. A guide rod or roller 53 spaced below supply reel 50 directs film 51 from the supply reel through the space between the anvil 31 and printing plate 36. Another guide rod could be located on the opposite side of the plate and anvil to guide the spent film to take-up reel 52. The supply and take-up reels are supported on rods or spindles 54 and 55 respectively that provide lateral adjustment to conform to various positions of the printing head and are adapted to receive rolls of different widths of film.

The individual printers operate in the following manner: When an envelope has been moved and momentarily stopped between printing plate 36 and anvil 31 by the retractable stop pins 10, the rod of the piston cylinder arrangement 43 is caused to move to the right as viewed in FIG. 3, which causes pins 42 to move horizontally in guide slots 41 and ride on tapered or inclined slots 38 forcing slideable support 37 and printing plate 36 down in printing engagement with the film and envelope on fixed anvil 31.

Illustrated in FIGS. 4 and 5 is an example of one type of paper board envelope to be printed. FIG. 4 shows the side of an envelope having information printed thereon at spaced locations $M^1$, $M^2$ and $M^3$ while FIG. 5 shows the other side of the envelope having information or indicia $M^4$ applied. The indicia at $M^1$ and $M^2$ are printed by the same printing head. These illustrations are mere examples, as different numbers thereof could obviously be applied without departing from the scope of the invention. Arrow B indicates the direction of travel of the envelopes as they move through the system. It is clear from these illustrations that the runs of the conveyor must be spaced differently to compensate for the difference in sizes of the area of printed information or messages illustrated in FIG. 4 and that illustrated in FIG. 5. Printers 1 and 2 are slightly staggered to print on the different areas as illustrated in FIG. 4.

A crank assembly 60 is associated with each of the printers 1, 2, 3 and offers side-to-side adjustment of the print head relative to the machine frame S and the envelope path thus providing proper print registration. A crank mechanism 61 on each print head serves to lock the print head in the adjusted position selected by displacement of the crank assembly 60.

The conventional sensing and control system is located on the support frame to sense various conditions and control various movements to motions of the above described structure. For example, upon starting the system an envelope E is fed from magazine M by feed means F and conveyor 4 to first printer 1, the presence of which is sensed by first sensor 8 which directs pins 10 through air cylinder 12, to move into the path of the envelopes, momentarily, simultaneously stops the feeding function and directs printer 1, via its actuating mechanism 36, 37, 38, 41, 42 and 43 to perform its printing function, e.g. printing plate 36 retracted, pins 10 withdrawn and feeder F and conveyor 4 are again actuated causing the just printed envelope E to move to printer 2 and a fresh envelope moved to printer 1. As previously pointed out printers 1 and 2 are arranged alike and when an envelope E is issued from magazine M to printer 1 and an envelope is issued from printer 1 to printer 2 they operate substantially simultaneously. Printer 3 receives an envelope from printer 2 as printer 2 receives an envelope from printer 1. Note, however, that printer 3 is positioned opposite to printers 1 and 2 and prints on the bottom of the envelope. Envelopes issuing from printer 3 are sensed by sensor 28 which actuates transfer device 20 to transfer the printed envelope to another work station WS.

The specific control systems CS for the various functions are known in the art and form no part of the present invention apart from defining an operative device and presenting a complete disclosure.

It will be manifest from the foregoing description that we have provided an apparatus which may be used to enable the hereinabove set forth and kindered objects of this invention to be realized, and while we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims.

We claim:

1. A printing system for printing indicia on opposite sides of relatively thin paper board article receiving envelopes, of the type having a frame along which envelopes are intermittently advanced to be momentarily positioned at plural generally aligned printing stations, the system comprising; a supply magazine for said envelopes; a plurality of spaced and generally aligned printing stations, each station including an anvil and a printing plate; conveying means for feeding the envelopes one at a time from said supply magazine to and through said printers between said printing plate and said anvil in an intermittent fashion, said conveying means including elongated, laterally spaced endless belts substantially spanning the distance from the supply magazine through the exit end of the most remote printer, said printing plates and said anvils being positioned for movement between the laterally spaced belts; means located at each printing station to sense an incoming envelope to momentarily interrupt the movement of the envelope and actuate said printer to print said envelope; and means locating at least one of said printers on one side of the path of movement of said envelope and another of said printers on the opposite side thereof to thereby print indicia on opposite sides of said envelope.

2. The invention as defined in claim 1 wherein each printer defines a fixed anvil and a movable printing plate.

3. The invention as defined in claim 2 wherein each printing plate is heated.

4. The invention as defined in claim 2 wherein each printer includes said moveable printing plate supported by a first vertically reciprocatable housing having inclined slots therein, and wherein horizontally reciprocatable drive pins are positioned within said slots and including means to reciprocate said pins along said inclined slots thereby displacing said first housing and thus said printing plate in a vertical plane.

5. The invention as defined in claim 4 wherein said means for reciprocating said pins including reciprocable motor means, said first housing being supported by a second fixed housing having said reciprocating motor means associated therewith and attached to said drive pins to move same horizontally to thereby move said printing plate into printing relationship with said envelopes.

6. The invention as defined in claim 5 wherein said second fixed housing includes means for supporting supply printing film reel means and spent film take-up reel means.

7. The invention as defined in claim 6 further including guide means for guiding printing film from said supply reel means, between said anvil and said moveable printing-plate and to said take-up reel means.

8. The invention as defined in either claim 2, further including means for supporting printing film reel means, spent film take-up reel means and means to guide said printing film between said anvil and said printing plate and to said take-up reel means.

9. The invention as defined in claim 1, wherein said means for sensing an incoming envelope to momentarily interrupt the movement of the envelope and actuate the associated printer includes, means for detecting the presence of an envelope, vertically moveable stop pins, actuator means for displacing said stop pins into the path of an incoming envelope in response to said detecting means to correctly position an envelope for printing.

10. The invention as defined in claim 1 further including intermittently actuated drive means for driving said belts.

11. The invention as defined in any one of claims 1 further including transfer means located adjacent the last printer to transfer the now printed envelope to a further work or processing station.

* * * * *